US006550724B2

(12) United States Patent
Gosling

(10) Patent No.: US 6,550,724 B2
(45) Date of Patent: Apr. 22, 2003

(54) SIT/STAND CONSOLE STRUCTURE

(75) Inventor: Geoff Gosling, Calgary (CA)

(73) Assignee: Evans Consoles Inc., Calgary (CA)

( * ) Notice: Subject to any disclaimer, the term of this patent is extended or adjusted under 35 U.S.C. 154(b) by 0 days.

(21) Appl. No.: 09/858,406

(22) Filed: May 16, 2001

(65) Prior Publication Data

US 2002/0171015 A1 Nov. 21, 2002

(51) Int. Cl.[7] ..... A47F 5/00

(52) U.S. Cl. ..... 248/125.2; 108/144.11; 108/147

(58) Field of Search ..... 248/125.2, 125.3, 248/917; 211/207; 108/144.11, 146, 147, 147.11

(56) References Cited

U.S. PATENT DOCUMENTS 5,289,782 A * 3/1994 Rizzi et al. ..... 108/146
5,370,063 A * 12/1994 Childers ..... 108/147
5,682,825 A 11/1997 Manner
5,687,655 A * 11/1997 Weinschenk et al. ..... 108/147
5,890,438 A 4/1999 Frankish
6,024,025 A * 2/2000 Koch et al. ..... 108/147
6,038,986 A * 3/2000 Ransil et al. ..... 108/145

* cited by examiner

*Primary Examiner*—Korie Chan
(74) *Attorney, Agent, or Firm*—Notaro & Michalos P.C.

(57) ABSTRACT

There is described a console structure frame for supporting one or more pieces of equipment comprising a plurality of equipment supporting members, a plurality of vertically upright horizontally spaced apart movable columns, a plurality of vertically upright horizontally spaced apart fixed columns, actuating plates slidably interconnecting the movable columns and the fixed columns and at least one actuator connected to at least one of the actuating plates, wherein the pieces of equipment supported by the equipment supporting members are adjustably raised or lowered when the movable columns are selectively moved relative to the fixed columns via the actuating plates upon activation of the actuator.

20 Claims, 7 Drawing Sheets

SIT/STAND CONSOLE STRUCTURE

FIELD OF THE INVENTION

The present invention relates to a framework for supporting pieces of work station equipment, and more particularly to a vertically adjustable console structure for supporting equipment.

BACKGROUND OF THE INVENTION

The need for flexibility in working environments is well known. In order to save overhead and space, it is often desirable that one piece of equipment serve multiple functions. This equipment and its supports must be flexible and adaptable to the changing needs to a business and their staff.

Proposed solutions to improve flexibility in work areas includes work station consoles that have retrofit capabilities. These console units provide flexibility by making it easier to change their configuration. However, retrofit can be costly and is often time consuming, leading to down-time for the equipment supported by the console.

The applicant has found that although there will continue to be a strong demand for the flexibility and retrofit capabilities of classic work station consoles, many customers now require accommodation for height adjustment not only of the work surface but also of the pieces of equipment in use in the console. The more vertically adjustable a console unit is the more flexibility available and the greater the comfort and unimpeded overall space available for workers.

It is clear that there exists a need for a new and improved console structure which obviates the foregoing problems and limitations, and which is relatively inexpensive and simple in construction and operation.

SUMMARY OF THE INVENTION

The present invention overcomes the deficiencies of the prior art by providing a console unit which is vertically adjustable and which provides a user the option of either sitting or standing at the console unit. This is accomplished by moving both the work space and the equipment housed within the console unit to a desired height, thus allowing more flexibility in how the user works.

The present invention provides both a fixed and a movable column structure, these structures being slidably mounted together. The present invention further provides at least one actuator to move the columns relative to each other. In this way, the fixed columns remain stationary and affixed to the ground while the moving columns can be vertically adjusted.

Equipment and work spaces are mounted to the movable column. This allows both to be easily adjusted in height simply by enabling the actuator, thereby expanding or contracting the movable column. In this way equipment flexibility is maximized and the time to change a console configuration is minimized, achieving the advantages of the present invention.

It is therefore an object of the present invention to provide a console structure frame for supporting one or more pieces of equipment, comprising a plurality of equipment supporting members, a plurality of vertically upright horizontally spaced apart movable columns, a plurality of vertically upright horizontally spaced apart fixed columns, actuating member plates slidably interconnecting said movable columns and said fixed columns, and at least one actuating member connected to at least one of said actuating member plates, wherein said pieces of equipment supported by said equipment supporting members are adjustably raised or lowered when said movable columns are selectively moved relative to said fixed columns via said actuating member plates upon activation of said actuating member.

It is further an object of the present invention to provide a console structure frame for supporting one or more pieces of equipment, comprising a plurality of equipment supporting members forming a movable frame, and means for automatically and selectively positioning said movable frame, wherein said pieces of equipment supported by said equipment supporting members are adjustably raised or lowered.

It is still further an object to provide a method for vertically adjusting a console structure frame for supporting one or more pieces of equipment, comprising the steps of connecting a plurality of vertically upright horizontally spaced apart movable columns to a plurality of equipment supporting members, slidably connecting a plurality of vertically upright horizontally spaced apart fixed columns to said movable columns through actuating member plates and connecting said actuating member plates to at least one actuating member.

BRIEF DESCRIPTION OF THE DRAWINGS

Preferred embodiments of the present invention will now be described in greater detail, and will be better understood when read in conjunction with the following drawings in which.

DETAILED DESCRIPTION OF THE DRAWINGS

Figure 1:
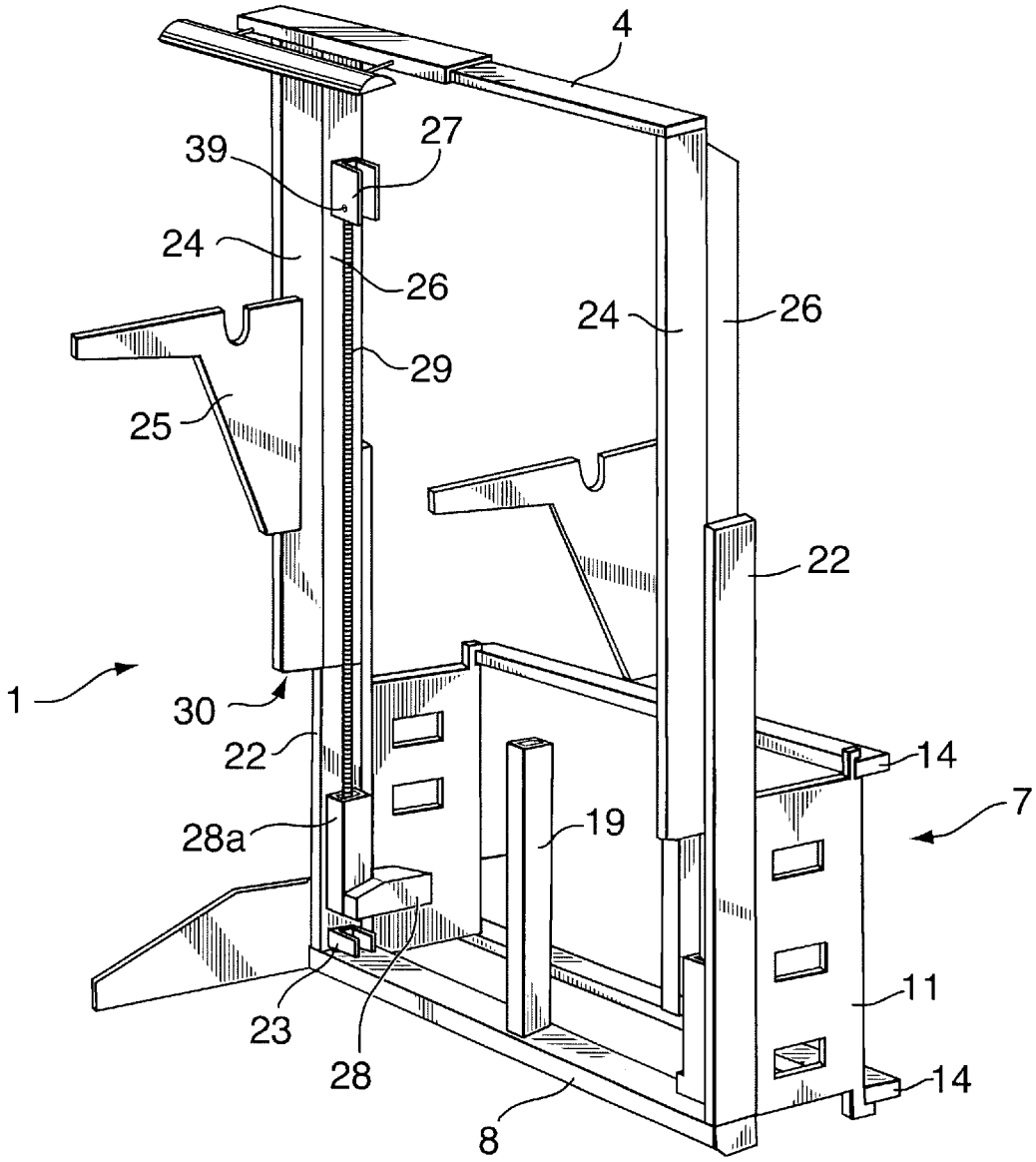
FIG. 1 is a front right isometric schematical representation of the underlying structure of a console structure including the present invention.

With reference once again to FIG. 1 there is shown schematically a typical console frame in accordance with the present invention adapted to support various pieces of computer hardware, lighting fixtures, other pieces of equipment and finishing panels. Not all consoles of course are adapted nor required to support computers or computer controlled equipment but as this is perhaps the most common use for such consoles, reference will be made to this application by way of example only. As well, the console described below is by way of example only, and the present invention is equally suited to other console structures.

Console 1 includes a column structure 30 on its left and right sides. Column structure 30 is used to raise and lower equipment easily within console 1 as will be described below. Each column structure 30 is comprised of a fixed column 22, a movable column 24, a driven column 26, an actuator 28, an actuator rod 29 and an actuator rod mount 27.

With the exception of column assemblies 30, console 1 may be substantially the same in terms of its structure and assembly as the console described in applicant's U.S. Pat. No. 6,382,747 issued May 7, 2002. The following therefore is a general description of the console framework, and this will be followed by a more specific description of column assemblies 30 and the drive mechanism used to raise and lower the assemblies to adjust the height of the console.

Figure 2:
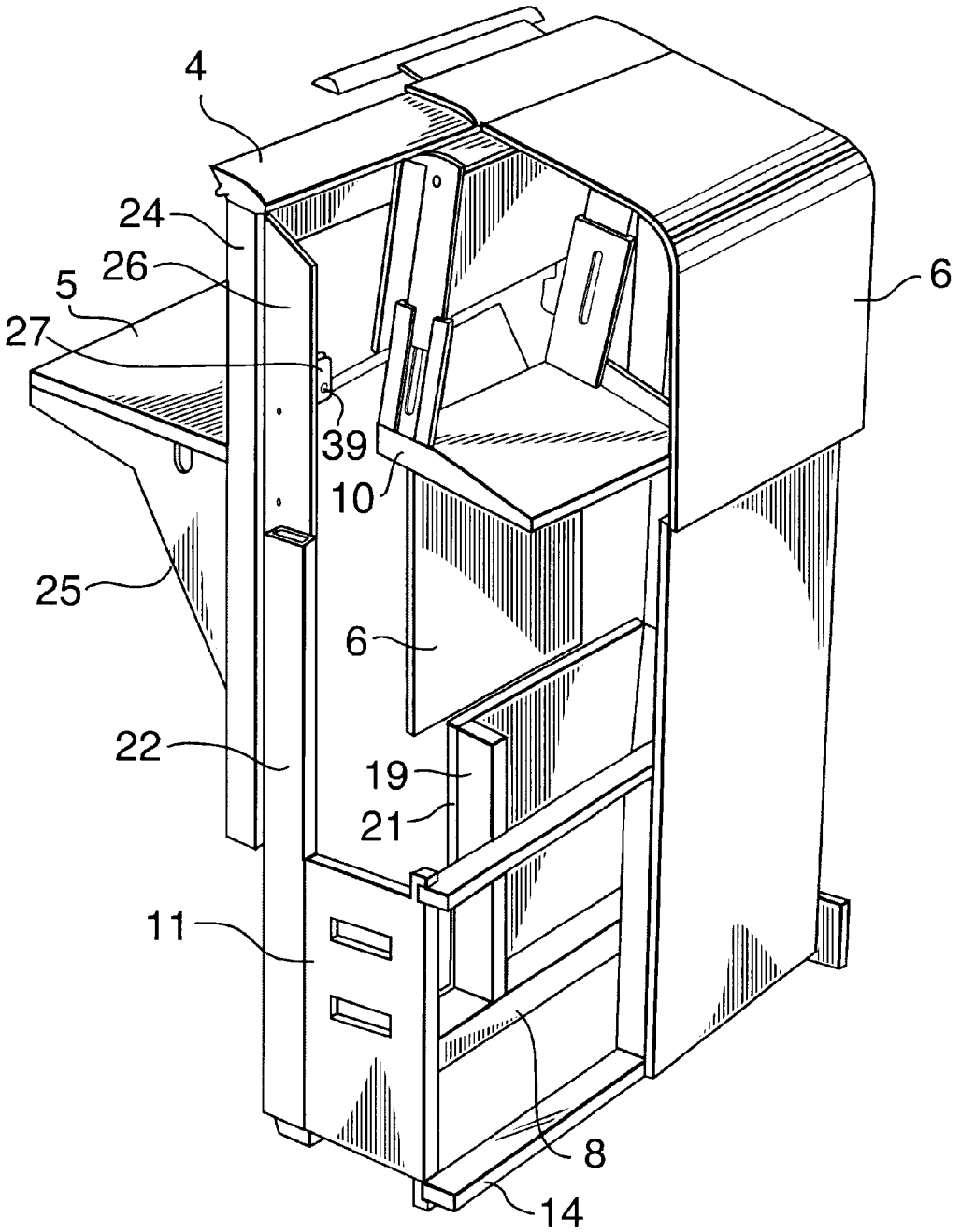
FIG. 2 is a rear isometric representation of the underlying structure of FIG. 1.

With reference to FIGS. 1 and 2, the basic elements of the console structure in accordance with the present invention include a plurality of horizontally spaced, vertically upright column assemblies 30 interconnected at their upper ends by an upper beam 4 and optionally at their lower ends by a lower beam 8. A box frame 7 consisting of rectangular end gables 11 and horizontal stringers 14 make up the base of the structural framework. As will be described below, upper and lower beams 4 and 8 and column assemblies 30 each perform a variety of functions.

The console also includes adjustable shelves or cradles 10 for supporting monitors and similar equipment within the console, a horizontal work surface 5 and external finishing panels generally indicated at 6 in FIG. 2. Lower beam 8 is adapted to a support post or posts 19 that serve as points of connection for cabinet doors 21 as shown most clearly in FIG. 2.

Column assemblies 30 serve as vertically upright, horizontally spaced apart posts. The columns are advantageously linearly extruded aluminum which is easily cut to length depending upon the required height of the console. The columns are interconnected as aforesaid by upper and lower beams 4 and 8 which creates a large unobstructed rectangular front portal into the console framework. In fact, as will be seen in the cross-sectional view of FIG. 3, and as will be described below, each column assembly comprises a pair of extrusions, namely, a lower fixed column or pillar 22 and an upper moveable column 24 interconnected by a driven column 26.

Columns 22 and 24 will typically be identical to one another in cross-sectional shape and, for purposes of this part of the description, are sometimes referred to collectively simply as column 30.

With references to FIGS. 1 and 2, each column assembly 30 is seen to directly support, from top to bottom, an end of upper beam 4, a horizontal work surface support 25 which in turn supports work surface 5, front panels 21 (which can be hinged cabinet-type doors) and the respective end of lower beam 8. The columns can also serve as points of connection for finishing panels 6. Lower beam 8 and lower horizontal stringer 14 can be used to support processor shelves 80 (slidable of fixed) as seen most clearly in the views of FIGS. 8 and 9.

In a preferred embodiment constructed by the Applicant, the ability of the columns to support a variety of other pieces is achieved by forming them with a plurality of longitudinally extending ports, cavities, slots and apertures for connection with various kinds of fasteners, PVC extrusions, bearings, rollers and other kinds of hardware as may be appropriate or needed for connection of other components. Reference is again made to FIG. 3 showing an example of a front column extrusion 30 in horizontal cross-section. As mentioned above, the column is advantageously formed by the extrusion of aluminum although other materials and methods of fabrication are available.

As shown, column 30 includes a front slot 31 that can be used to connect the adjustable or fixed work surface brackets 25 or a trim strip 48, a T-slot 32 that can be used to engage the post of a leveller 35 or a threaded captive fastener, a central cavity 36 for a column tierod 37 the purpose of which will be described below, a port 38 for a cable management clip or the like and a cavity 33 for roller bearings 40 that can be optionally provided on work surface supports 25 that allow the work surface height to be adjusted up and down as required and for driven column 26 so that it can be moved up and down to adjust the height of the console itself. The work surface, if independently adjustable, can be raised and lowered by means of a crank operated lifting mechanism such as that described in applicant's U.S. Pat. No. 5,809,908 issued Sep. 27, 1998.

Figure 9:
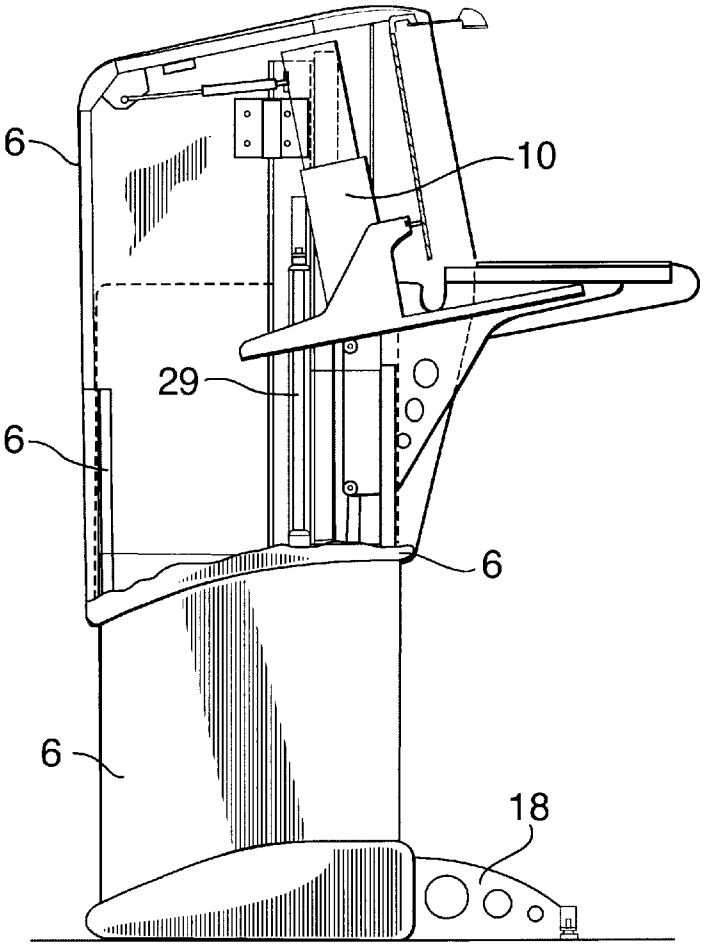
FIG. 9 is a side elevational view of the present console in a fully raised position.
Figure 8:
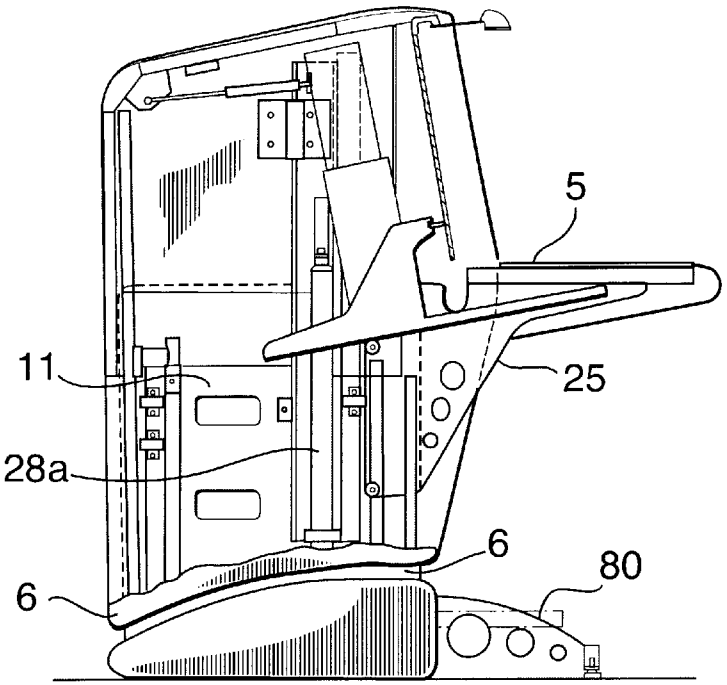
FIG. 8 is a side elevational view of the present console in a fully lowered position.

Columns 30 also includes some additional T-slots 45 adapted to receive standard square or hex nuts for connection to threaded fasteners to mount or attach other components like stringers, hinges for doors 21, clips, mounting brackets, hooks for supporting finishing panels or anything else specified by the customer, including support feet 18 all as shown in greater detail in FIGS. 8 and 9.

Figure 5:
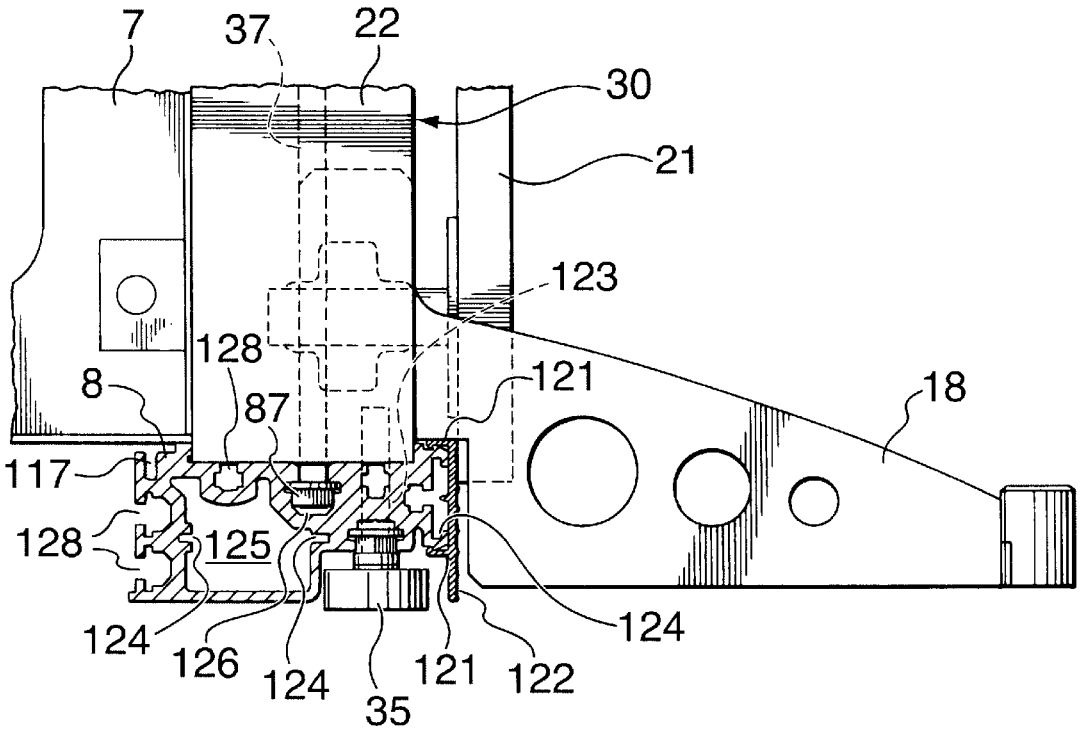
FIG. 5 is a side elevational view of the lower beam of the console of FIG. 1.

Reference is now made to FIG. 5 showing an example of extruded lower beam 8 in cross-section. The lower beam includes a pair of bevelled shoulders 121 for a snap-fit connection to a baseboard 122, an aperture 123 for leveller 35, slots 124 for splines (not shown) that can be used to connect adjacent lower beams together, a cavity 126 for the lower end of tierod 37 and some additional T-slots 128 for cable management clips and for various nuts and other hardware useful to connect or attach other parts as needed. A longitudinally extending ribbed or threaded recess 117 is provided for fasteners and the like used to connect processor shelves, rack mounts and so forth.

Figure 6:
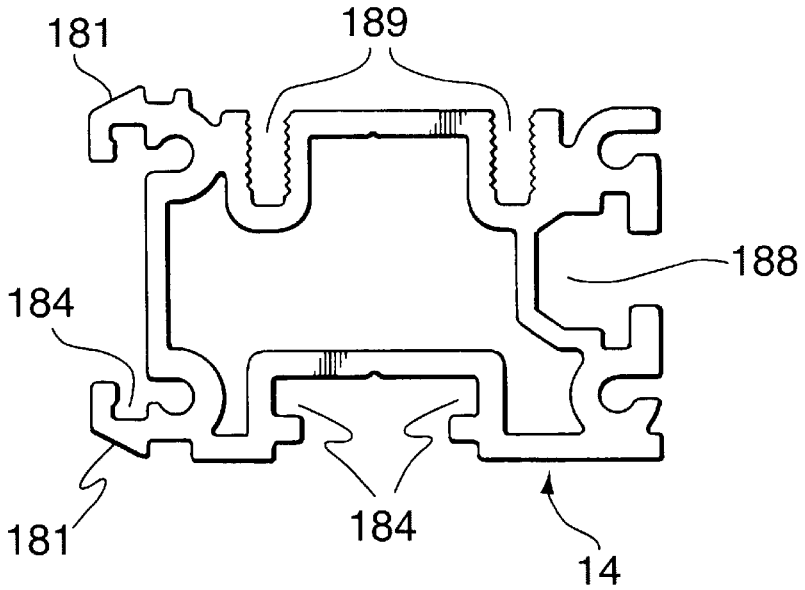
FIG. 6 is a side elevational view of stringer 14 of the console of FIG. 1.

Lower rear stringer 14 is shown in detail in the cross-sectional view of FIG. 6. The stringer includes a pair of bevelled shoulders 181 for a snap fit connection to a baseboard 122, slots 184 for splines or other sheet metal connectors (neither shown) that can be used to connect adjacent stringers together, a T-slot 188 for various nuts or other hardware useful to connect or attach other parts such as structural frame components like end gables 7 and longitudinally extending ribbed recesses 189 (screw ports) to receive fasteners for connecting processor shelves and other pieces of equipment.

Figure 7:
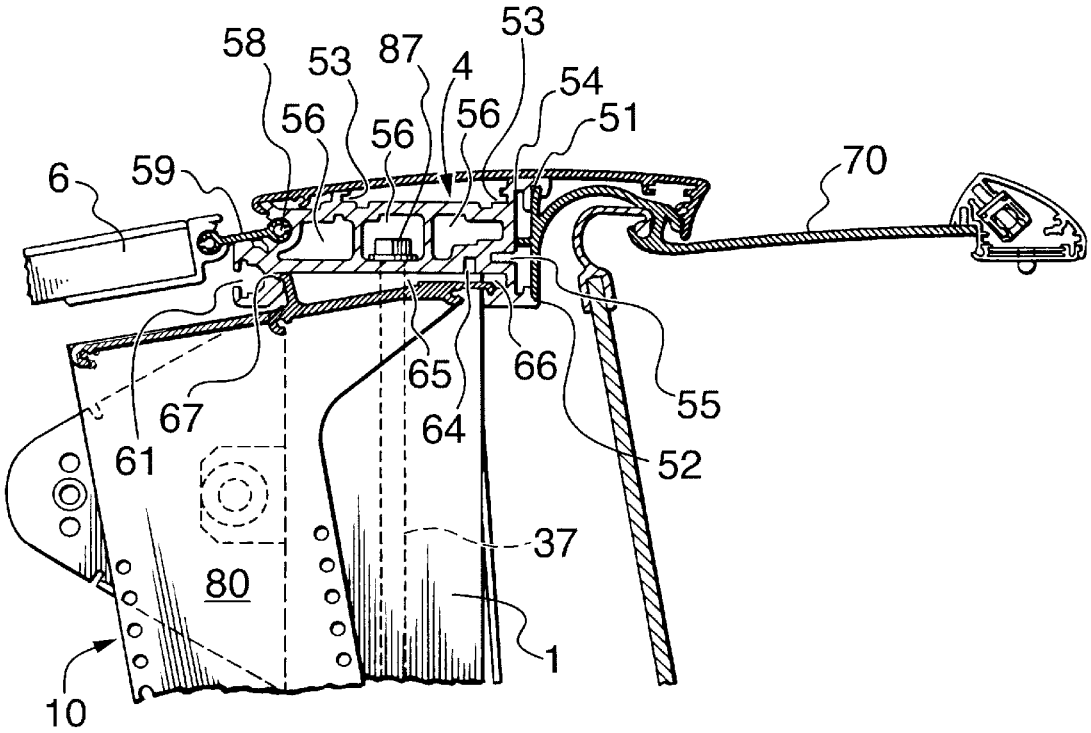
FIG. 7 is a vertical cross-sectional view of the upper beam of the console of FIG. 1.

Reference will now be made to FIG. 7 showing upper beam 4 in cross-section. This beam as well is advantageously an aluminum extrusion.

As shown, upper beam 4 includes a front notch 51 and cooperating shoulder 52 for a leveraged connection to task light arm 70, a slot 54 with a grooved channel 55 that can be used for the connection of splines (not shown) that in turn are used to connect adjacent beams 4 together, some central cavities 56, one of which receives the upper end of column tierod 37 and a circular cavity 58 for a hinge 59 that connects to pivotable back panel 6. An additional port 61 is provided that can be used for flanged nuts, cable management clips or other hardware that might be needed at this spot. An additional slot 53 is provided for a spline used to connect adjacent beams at corner sections.

The lower surface of beam 4 includes a slot 65 including a forward portion 66 and a rearward portion 67. There is also a notch 64 that allows for the connection of a work surface bracket without any fastener. Slot 65 is used to connect with monitor cradles 10 to suspend them from beam 4 as shown in the drawings.

With reference once again to FIG. 5, additional rigidity in the console framework can be obtained by compressive loading of fixed column 22 between the column's upper end and lower beam 8. This can be accomplished by means of the tierod 37 extending through the column and the lower beam with the loading being applied by nuts 87 tightened onto the rod's opposite ends as shown.

Finishing panels 6 can be applied to the console framework in any known manner to complete the structure's finished appearance.

Figure 3:
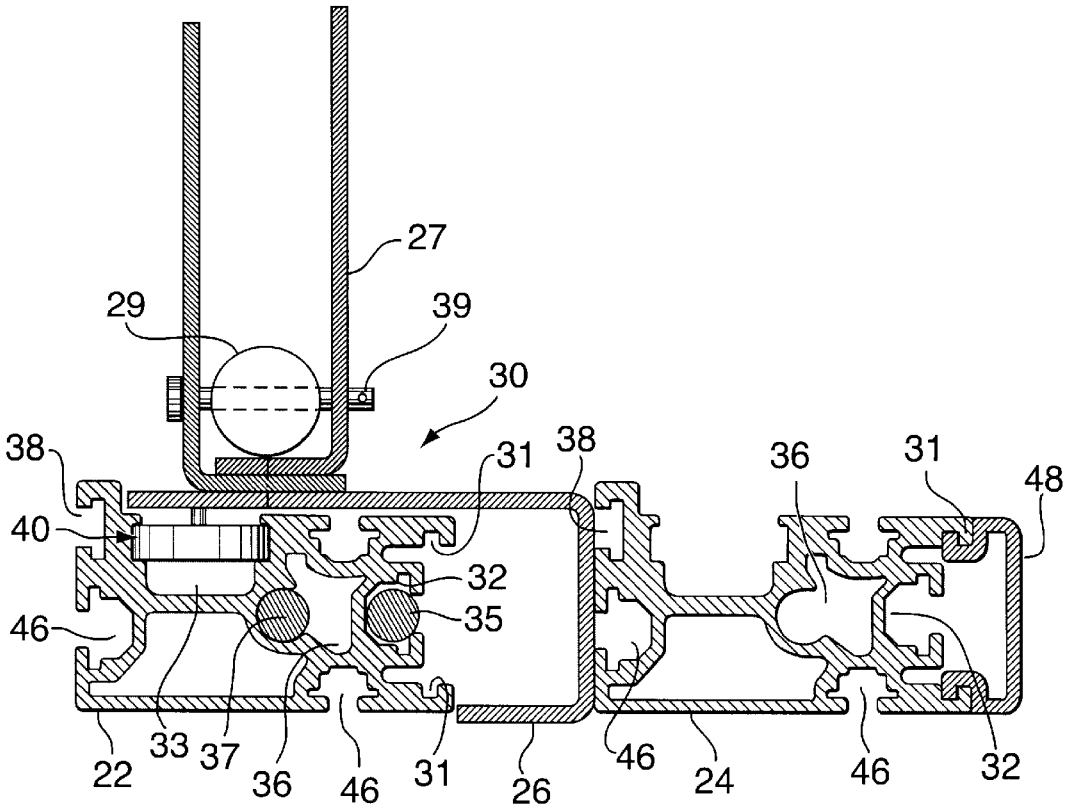
FIG. 3 is a horizontal cross sectional view of the column assembly of the present invention.
Figure 4:
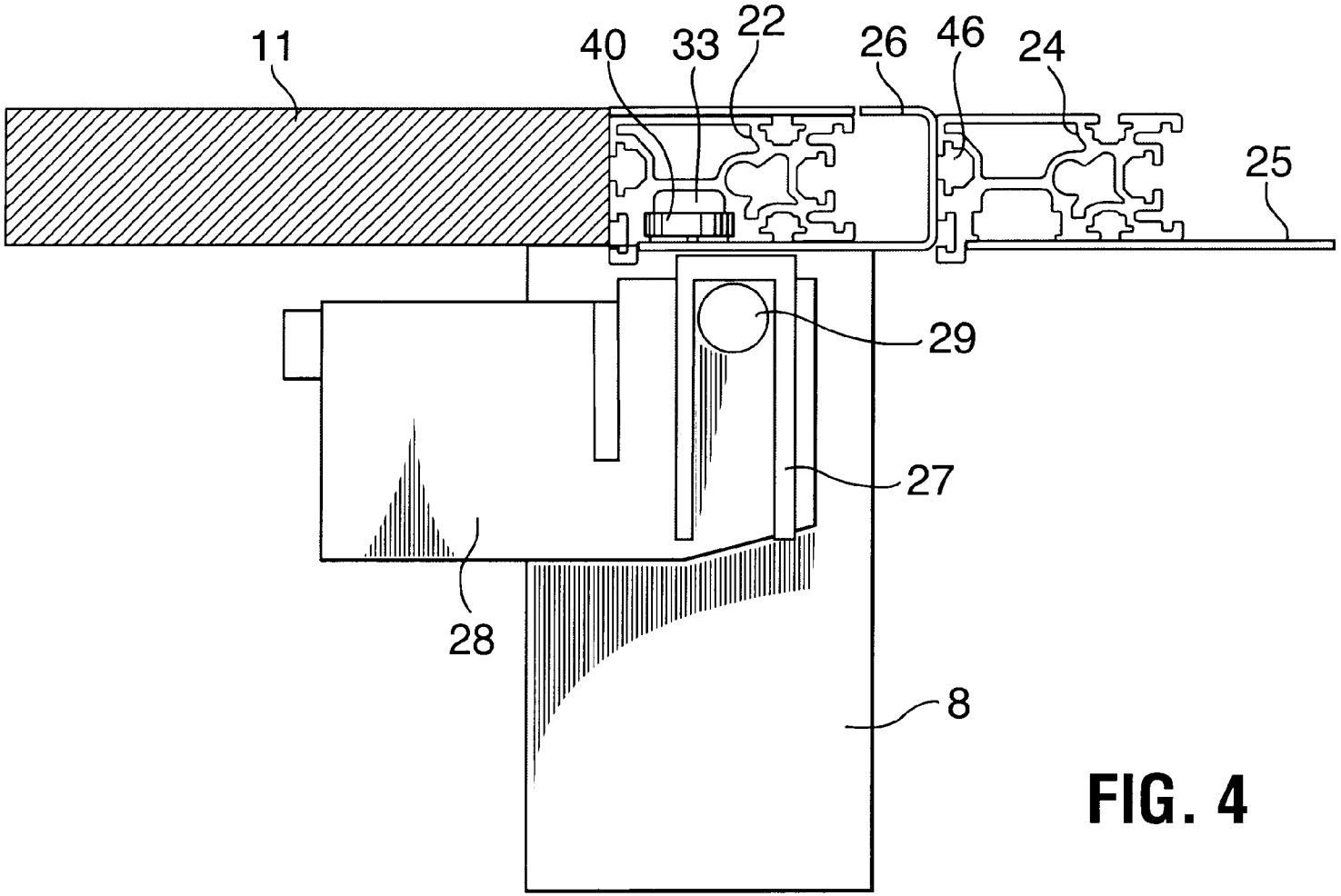
FIG. 4 is a plan view of column assembly/actuator mount assembly of the present invention.

With reference to FIGS. 3 and 4, column assembly 30 and its operation will now be described in greater detail. As aforesaid, fixed column 22 and movable column 24 are each preferably a length of aluminum extrusion cut to the desired length depending upon the minimum and maximum console heights for the sit/stand configuration. The two columns are connected for relative movement therebetween by a generally channel shaped driven column 26 that is fixedly connected to movable column 24 such as by means of threaded fasteners using T-slots 46, and movably connected to fixed column 22 by means of a plurality of vertically spaced apart rollers 40 received into cavity 33.

Driven column 26 includes a bracket 27 which connects to the upper end of actuator rod 29 by means, for example, of a retractable pin member 39.

The drive means for each column assembly can be seen most clearly from the view of FIG. 1. A mounting bracket 23 is attached to lower beam 8 to support electric actuator 28 adjacent the base of column assembly 30. Actuator rod 29 extends upwardly from the actuator for connection to bracket 27 on driven column 26. In a preferred embodiment constructed by the applicant, actuator 28 includes an upwardly extending tubular sleeve 28*a* which encloses a rotatable threaded bushing to engage cooperating threads on the lower end of actuator rod 29. The threaded bushing is rotated in one direction to raise the rod and in the other direction to lower it to in turn raise and lower the console structure.

Preferably, each column is provided with its own drive means which are wired together from a single power supply to ensure that driven columns 26 are raised or lowered by the same amount. In lower cost installations, a single drive means can be used for two or more columns, or a single drive means can be mounted between two columns with the upper end of rod 29 connecting to upper beam 4.

With reference to FIGS. 2 and 7 and 9, the base of the console is provided with finishing panels 6. The upper movable portion of the console is fitted with panels 6 connected to beam 4 and movable columns 26 for up and down movement therewith. The vertical portions of the upper finishing panels are spaced outwardly of the vertical outer surfaces of the lower panels to move past them as the console is raised or lowered. The panels have sufficient vertical height that in the fully raised position of the console, the panels will still overlap one another to avoid unsightly gaps.

The console will of course be provided with a switch to operate actuator 26 to raise and lower the console between its lowermost position shown in FIG. 8 and its uppermost position shown in FIG. 9.

The above-described embodiments of the present invention are meant to be illustrative of preferred embodiments and are not intended to limit the scope of the present invention. Various modifications, which would be readily apparent to one skilled in the art, are intended to be within the scope of the present invention. The only limitations to the scope of the present invention are set forth in the following claims appended hereto.

I claim:

1. A console structure frame for supporting one or more pieces of work station equipment, comprising:

a) one or more equipment supporting members for said pieces of work station equipment;

b) a plurality of vertically upright horizontally spaced apart movable columns interconnected at their upper ends by an upper beam;

c) a plurality of vertically upright horizontally spaced apart fixed columns;

d) actuating member plates slidably interconnecting said movable columns and said fixed columns; and e) at least one actuating member connected to at least one of said actuating member plates;

wherein said pieces of work station equipment supported by said equipment supporting members are adjustably raised or lowered when said movable columns are selectively moved relative to said fixed columns via said actuating member plates upon activation of said actuating member.

2. The console structure of claim 1 wherein said fixed columns are interconnected at their lower ends by a lower beam.

3. The console structure of claim 1 wherein said movable columns and said fixed columns are extruded aluminum.

4. The console structure of claim 1 wherein said movable columns and said fixed columns respectively support upper and lower finishing panels for said console structure, said upper and lower panels being laterally offset relative to each other whereby said upper panels can move past said lower panels during movement of said movable columns.

5. The console structure of claim 1 wherein said actuating member is an electric, hydraulic or pneumatic driving mechanism.

6. The console structure of claim 1 wherein said actuating member plates and said at least one actuating member are interconnected by an operational cylinder.

7. The console structure of claim 1 wherein one of said supporting members is independently adjustable for selectively moving a work surface.

8. The console structure of claim 1 wherein said pieces of equipment are vertically adjustable between a sitting position and a standing position for an operator of said work station equipment.

9. A method for vertically adjusting a console structure frame for supporting one or more pieces of equipment, comprising the steps of:

a) connecting a plurality of vertically upright horizontally spaced apart movable columns to a plurality of equipment supporting members, one of said supporting members being independently adjustable for selectively raising and lowering a work surface;

b) slidably connecting a plurality of vertically upright horizontally spaced apart fixed columns to said movable columns through actuating member plates; and c) connecting said actuating member plates to at least one actuating member actuatable to adjustably raise or lower said movable columns.

10. The method of claim 9 wherein said pieces of equipment are vertically adjustable between a sitting position and a standing position.

11. A vertically adjustable console structure framework for supporting one or more pieces of work station equipment, comprising:

at least one pair of vertically upright horizontally spaced apart fixed columns;

a vertically upright movable column operatively associated with each of said fixed columns for vertical up and down movement relative to each of said fixed columns, the upper ends of adjacent ones of said movable columns being interconnected by an upper beam member;

one or more equipment supporting members for said pieces of work station equipment connected to said upper beam member for up and down movement therewith; and at least one actuator drivingly connected to at least one of said movable columns, wherein said pieces of work station equipment supported by said equipment supporting members are adjustably raised or lowered when said movable columns are selectively moved relative to said fixed columns upon activation of said actuator.

12. The console structure framework of claim 11 additionally including a substantially horizontal work surface connected to adjacent ones of said fixed columns for up and down movement therewith.

13. The console structure framework of claim 12 wherein said work surface is independently vertically adjustable relative to said movable columns.

14. The console structure framework of claim 13 wherein said fixed columns are interconnected at their lower ends by a lower beam.

15. The console structure framework of claim 11 wherein said movable columns and said fixed columns respectively support upper and lower finishing panels for said console structure, said upper and lower panels being laterally offset relative to each other whereby said upper panels can move vertically past said lower panels during movement of said movable columns.

16. The console structure framework of claim 11 wherein said actuator is an electric, hydraulic or pneumatic motor.

17. A method for vertically adjusting the height of a console structure framework and pieces of work station equipment supported thereon, comprising the steps of:

movably connecting at least one pair of vertically upright movable columns to a respective at least one pair of vertically upright horizontally spaced apart fixed columns;

connecting together the upper ends of said at least one pair of movable columns by a beam member;

connecting one or more equipment supporting members adapted to support pieces of said work station equipment thereon to said beam member; and drivingly connecting a prime mover to at least one of said movable columns, said prime mover being selectively operable to move said movable columns up and down relative to said fixed columns whereby the height of said work station equipment relative to an operator thereof is adjustable.

18. The method of claim 17 including the additional step of connecting a horizontal work surface to said at least one pair of movable columns for up and down movement therewith.

19. The method of claim 18 wherein said work surface is independently vertically adjustable relative to said at least one pair of movable columns.

20. The method of claim 19 wherein said pieces of work station equipment are vertically adjustable between a sitting position and a standing position of the operator.

* * * * *